United States Patent [19]

Bowles et al.

[11] Patent Number: 4,886,197

[45] Date of Patent: Dec. 12, 1989

[54] ANTI-THEFT HOLSTER

[76] Inventors: Dale D. Bowles, 2443 Hemlock; Charles L. Parmley, 23 Kelly Dr., both of Granite City, Ill. 62040

[21] Appl. No.: 199,800

[22] Filed: May 27, 1988

[51] Int. Cl.[4] ..... F41C 33/04

[52] U.S. Cl. ..... 224/243; 224/192; 224/245; 224/247; 224/911

[58] Field of Search ..... 224/192, 193, 196, 198, 224/206, 242, 243, 244, 245, 246, 247, 911, 912

[56] References Cited

U.S. PATENT DOCUMENTS

| | | | |
|---|---|---|---|
| Re. 30,139 | 9/1975 | Jones | 224/243 |
| 1,148,935 | 8/1915 | Shavely | 224/911 X |
| 1,421,578 | 7/1922 | Schussler | 224/243 |
| 2,132,323 | 10/1938 | Sander | 224/911 X |
| 2,577,869 | 12/1951 | Adams | 224/193 |
| 3,011,687 | 12/1961 | Boyt | 224/243 |
| 3,630,420 | 12/1971 | Bianchi | 224/193 |
| 3,718,240 | 2/1973 | Rose | 224/243 |
| 3,865,289 | 2/1975 | Boren | 224/193 |
| 4,101,060 | 7/1978 | Bianchi et al. | 224/193 |
| 4,485,947 | 12/1984 | Cook | 224/243 |

FOREIGN PATENT DOCUMENTS

| | | | |
|---|---|---|---|
| 174908 | 3/1986 | European Pat. Off. | 224/193 |

*Primary Examiner*—Henry J. Recla
*Assistant Examiner*—Robert M. Fetsuga
*Attorney, Agent, or Firm*—Richard G. Heywood

[57] ABSTRACT

An anti-theft pistol holster having a body casing with a lower muzzle end and an upper access opening, a yieldable member adjacent the muzzle end for yieldably seating the muzzle of a pistol, a rigid keeper member adjacent the upper opening in opposed relation to the yieldable means and being movable between a position of positive engagement with the butt of a pistol and a released position disengaged from the pistol butt.

18 Claims, 2 Drawing Sheets

ANTI-THEFT HOLSTER

FIELD OF THE INVENTION

The invention relates generally to holsters for automatic and semi-automatic pistols used by law enforcement personnel, and more particularly to an anti-theft holster for retaining such a weapon against unauthorized removal.

DESCRIPTION OF THE PRIOR ART

Holsters for automatic and semi-automatic handguns, generically referred to as "pistols" herein, are conventionally designed and sized to accommodate a specific pistol model and form a convenient carrying case or sheath for safely housing such pistols for ready accessibility and use, such as by law enforcement personnel. Although any pistol model should fit snugly into a holster designed for it and most holsters include a cover flap or retaining strap of some type for holding the pistol against accidental displacement, a recurring problem in recent years has been the theft of the pistol by a prisoner grabbing the pistol and jerking it out of the holster to be used for escape and thereby placing the law officer in life threatening jeopardy. The prior art shows several holstering devices for latching a pistol against inadvertent or unauthorized displacement, but have not solved the primary problem of providing a means for positively engaging and "locking" the pistol into the holster while being capable of quickly releasing the gun when needed by the law officer.

Snavely 1,148,935 shows a holster for an automatic pistol in which a spring-loaded plunger acts on the gun muzzle to cam the butt end of the pistol into a chamber and against a holster wall shoulder to prevent lateral displacement except by depressing the pistol to clear this shoulder. Adams 2,577,869 is similar in showing a holster having a leaf spring acting on the muzzle to engage the hammer thumb spur of a pistol behind a metal clip forming an abutment shoulder at the top of the holster. Schussler 1,421,578 and Rose 3,718,240 both show spring loading devices engageable only at the muzzle end with the front sight of the pistol.

SUMMARY OF THE INVENTION

Briefly summarized, the invention comprises an anti-theft holster having a holster body casing with a lower muzzle end and an upper opening, a resilient saddle member adjacent to the muzzle end for yieldably seating the muzzle of a pistol, a rigid keeper member adjacent the upper opening in opposed relation to the resilient means and being movable between a position of positive engagement with the butt end of the pistol and a released position disengaged from the pistol butt. The invention is further embodied in the method of making the anti-theft holster.

The principal object of the present invention is to provide an anti-theft holster which will provide positive locking engagement with a pistol housed therein, but permit quick release for withdrawal of the pistol for use.

Another object is to provide an anti-theft holster for use by law enforcement personnel that will lock a pistol therein and prevent unauthorized removal or inadvertent displacement.

Another object i to provide a holster for an automatic and semi-automatic pistol, and which has a simple, inexpensive, but positive-acting locking device for securing the pistol therein.

These and other objects and advantages will become more apparent hereinafter.

DESCRIPTION OF THE DRAWINGS

The invention is further embodied in the structure and the parts and combinations of parts hereinafter described and claimed. In the accompanying drawings which form a part of the specification and wherein like numerals refer to like parts wherever they occur:

DESCRIPTION OF THE PREFERRED EMBODIMENT

The present invention is applicable to holsters for most types of automatic and semi-automatic pistols used by law enforcement personnel and the like, including .38 caliber, 9 mm. and .45 cal. handguns. Basically, the two types of pistols available are revolvers, which have a rotating cylinder with several chambers brought successively into firing line with the barrel, and slide cocking pistols, which bring successive rounds of ammunition from a magazine clip in the handle into the firing chamber (and eject spent cartridges therefrom) by the reciprocal action of a slide on the barrel. In both types of pistols, the firing hammer is automatically cocked and fired by pulling the trigger, although in a revolver the trigger also actuates the cylinder rotation whereas in a slide type weapon it is the firing of a round that results in rearward slide movement to eject the spent shell and inject a live round in the firing chamber. In both types the firing hammer can also be manually cocked. Clearly, the size and shape of the pistol itself will dictate the basic configuration of the holster.

Figure 1:
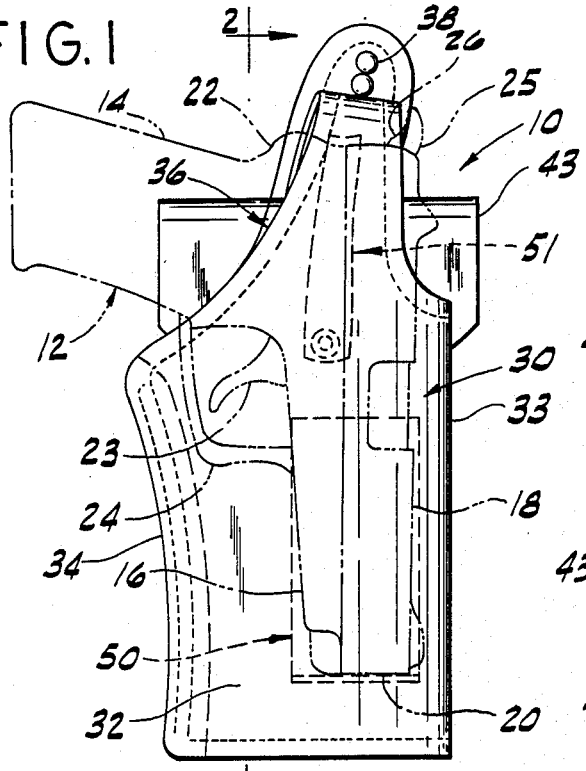
FIG. 1 is a side elevational view of a holster embodying the present invention and with a pistol being shown in phantom lines for environmental purposes.
Figure 4:
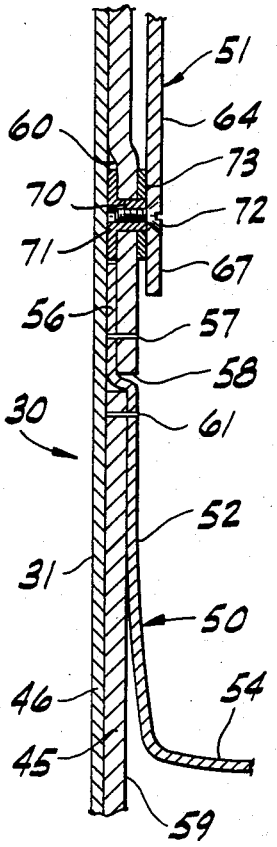
FIG. 4 is a greatly enlarged fragmentary cross-sectional view taken substantially along line 4—4 of FIG. 3.

For disclosure purposes an anti-theft holster 10 embodying the invention is shown with a 9 mm. automatic pistol 12. As shown in FIGS. 1 and 4, the main body of the pistol 12 includes a handle section 14 housing a magazine clip (not shown), a barrel section 16 having a rearward firing chamber (not shown) to receive a round of ammunition from the clip, and a slide 18 that reciprocates on the barrel section 16 during use. The barrel and slide (16, 18) have a front muzzle end 20. The butt end of the pistol body 12 is curved rearwardly at the juncture of the handle and barrel sections (14, 16) to form a outward shoulder 22 or like offset that assists in properly locating the user's hand vertically to grip the handle section and squeeze the trigger 23 within trigger guard 24 on the opposed side of the handle section 14. Most pistol models also have a rearwardly projecting thumb spur 25 formed on the firing hammer (not shown) to permit manually cocking the hammer. This thumb spur 25 also forms an outward shoulder 26 spaced above the shoulder 22 and, together with the barrel/slide (16, 1B). defines a recess, shown generally at 27, on the butt end of the pistol body 12 in opposed relation to the muzzle end 20.

Figure 2:
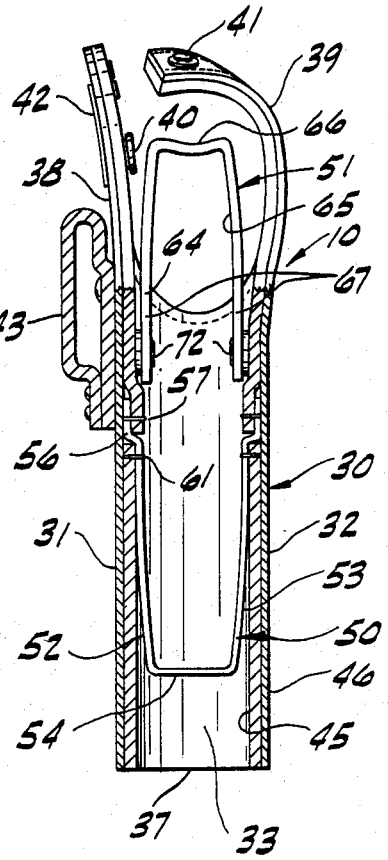
FIG. 2 is a view taken substantially along line 2—2 of FIG. 1, but with the holster lock strap being opened.
Figure 3:
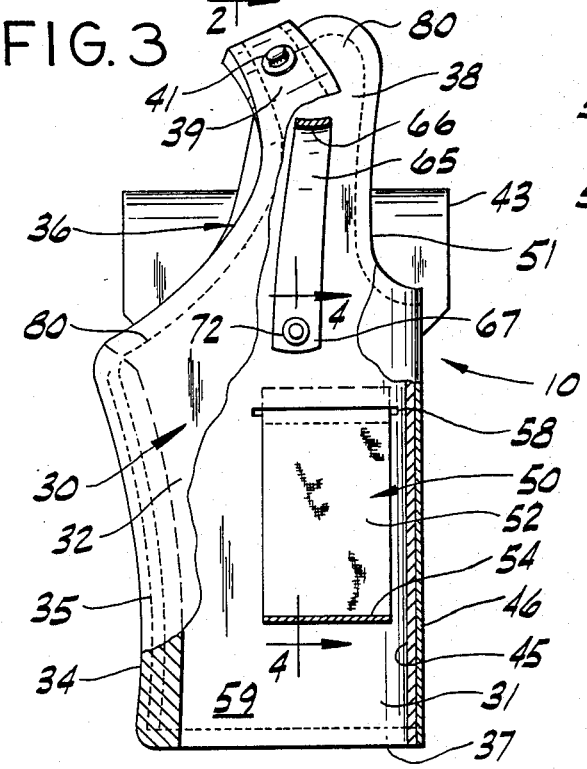
FIG. 3 is another side elevational view of the present holster, partly broken away to show the inventive features.

Referring to FIGS. 1–3, the holster 10 conventionally includes a main body or casing 30 forming a sheath for housing the pistol 12, the main body being made from an integral single sheet or multi-ply blank of leather that is folded and shaped to form an inside or rear wall section 31 and an outside or front wall section 32 integrally connected by a curved or bent forward section 33. The rearward marginal edges 34 of the walls 31, 32 are brought together, sometimes with a spacer strip (not shown) and stitched, as at 35. The body casing defines an interior sheath chamber or pocket for the pistol 12 having a main upper and rearward opening 36 for insertion and withdrawal of the pistol and a lower or bottom opening 37 may also be provided. In a typical holster construction, the rear wall section 31 is formed with an upwardly extending vertical rear or back strap member 38, and the front wall section 32 is provided with an upwardly extending curved front or closing strap member 39. These lock strap members 38 and 39 are provided with mating fastening means, such as a female snap fastener element 40 on the rear strap 38 and a male snap fastener 41 on the front strap 39, and the front strap 39 wraps around or folds over the butt end of the pistol 12 and is secured to the rear strap 38 by the fasteners 40, 41 to retain or "lock" the pistol into the sheath pocket. Also, in locked condition the top of the rear strap 38 extends above the closing strap 39 and forms an upstanding tab, and the rearward face of the rear strap 38 may be provided with a vertical rib or strip 42 to further rigidify this tab and strap member 38. As shown, the vertically disposed rib 42 is formed of metal and is secured to the exterior of the upstanding tab of strap 38, but an insert rib or strip formed of "memory" plastic can be secured between the plies of a multi-ply lock strap 38. Any such construction is referred to as a "thumb break lock strap" since simple pressure by the side of the thumb or its heel against the upstanding tab translates through the rib 42 to the female fastener 40 causing the fastener elements 40, 41 to separate and disengage the straps 38, 39 for withdrawal of the pistol 12. In addition, a two ply belt loop 43 reinforced with a steel insert or the like is securely fastened to the rear wall 31 for attaching the holster 10 onto the user's belt (not shown) in a typical manner.

As shown best in FIGS. 2 and 4, the holster 10 of the present invention is preferably formed of heavy duty, multi-ply leather having an inner ply or layer 45 and an outer ply or layer 46 that are laminated together in the process of making the holster 10, as will appear. The outer ply 46, in addition to strengthening the inner ply 45 and structurally containing certain parts, may also provide a dress finish to the entire holster body. Thus, the outer ply 46 may be formed of a high luster plastic or other suitable material, or the holster body may have an exterior dress ply of high gloss "patent leather".

The holster 10 includes an interior pistol latching or retaining mechanism which with the thumb break lock straps 38, 39 forms a "double lock" to prevent unauthorized removal of a pistol 12 housed in the holster. The latching mechanism comprises a resilient saddle or sling member 50 for yieldably seating the muzzle end 20 of the pistol within the holster 10 and exerting an upward biasing force thereon, and a non-yielding or rigid keeper member 51 in opposed relationship with the resilient member 50 for locking engagement with the pistol butt. The resilient saddle member 50 preferably is in the form of a unitary or integral elastic U-shaped band or strap made of high strength elastic nylon or like expansible material. The resilient strap member 50 has vertical rear and front side wall sections 52 and 53 interconnected by a bottom web wall or saddle section 54, and the upper end portions 56 of the side walls 52, 53 are secured to at least the inner ply 45 of the rear and front holster body walls 31, 32, as by heavy duty stitching 57 or adhesive bonding or the like. With reference particularly to FIG. 4, in the preferred embodiment, opposed elongated horizontal slots 58 extend between the inner wall surface 59 and the outer interface surface 60 of the inner ply 45 approximate to the vertical center of the holster body 30. The end portions 56 of the saddle member 50 are extended through these slots 58 and upwardly in surface engagement with the outer interface surface 60 of the inner ply 45 and stitched (57) thereto during assembly as will be discussed. It will be understood that by fixing the end portions 56 of the elastic strap member 50 between the body wall plies 45, 46, the inner ply overlies and contains the end portions 45 46 to isolate them from the internal sheath chamber and prevent the ends from being caught or snagged by the pistol and tearing away from the body casing 30. If desired, one or more additional rows of heavy duty stitches 61 may be employed to secure the side walls 52, 53 to the inner surface 59 of the inner ply 45 below the horizontal slots 58. Thus, the upper end portions 56 of the U-shaped resilient strap 50 are securely attached at a predetermined vertical location to the opposed side walls 31, 32, and the side walls 52, 53 extend downwardly along the inner wall surfaces 59 to locate the closed loop of the saddle section 54 at a predetermined position above the muzzle end 37 of the holster body 30 for receiving and yieldably seating the muzzle 20 of the pistol 12.

Figure 5:
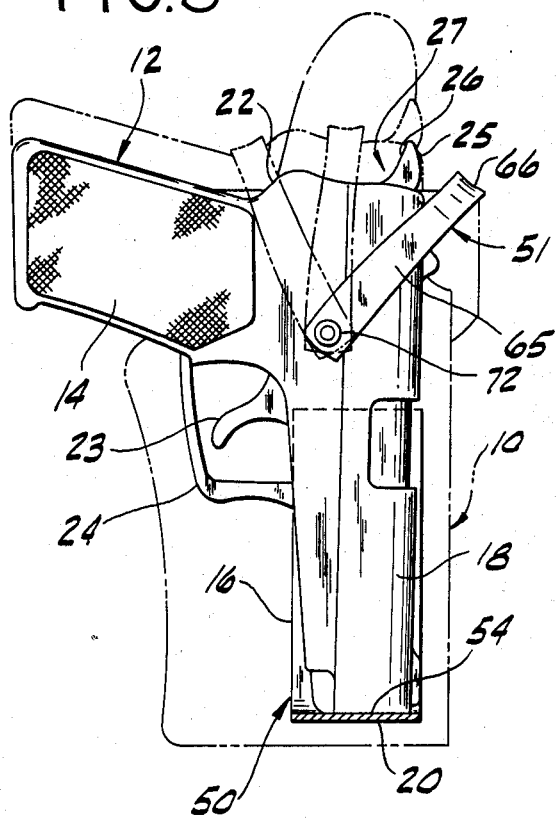
FIG. 5 is a diagrammatic view illustrating the manner of operation.

The keeper member 51 is preferably in the form of a unitary or integral relatively rigid U-shaped strap made of leather or molded plastic, and has vertically extending rear and front side wall sections 64 and 65 interconnected by a top wall or yoke section 66 that may be shaped with a longitudinal and transverse curvature or arch, as may be desired for engagement with a pistol butt configuration. The lower end portions 67 of the side walls 64, 65 are hingedly connected to the rear and front walls 31, 32 to provide pivotal movement of the keeper member 51 within the holster body. Referring to FIG. 4, in the preferred embodiment the inner ply 45 of the rear and front walls 31, 32 is punched with opposing openings 70 centrally above the horizontal slots 58. A T-nut fastener 71 is positioned in these openings 70 from the interface surface 60, and hinge pins or bolts 72 pivotally fasten the ends 67 of the keeper 51 to these fasteners 71 with intervening washers 73 being provided to facilitate free swinging movement of the keeper member 51. The side walls 64, 65 extend upwardly from their pivotal location and locate the yoke section 66 in an operative gun retaining or locking position in which the yoke section 66 overarches or straddles the pistol butt within the recess 27 or behind the thumb spur shoulder 26 or shoulder 22 and defines the upper limit of housed pistol movement in the holster body 30. The upward biasing force of the resilient saddle member 50 on the pistol muzzle 20 keeps the pistol in its upper locked position and prevents lateral pivotal movement of the keeper member 51. In this position the keeper yoke is positioned within and closely adjacent to the curvature of the lock strap 39 when in fastened position housing a pistol 12 and, thus, the pistol 12 is "double locked" in the holster 12. Preferably the lock strap 39 bears against the keeper yoke 66 to frictionally retain it in its gun retaining position except under a positive pivoting force even if the pistol 12 is depressed within the holster body 30, and this close proximity of the lock strap 39 also obscures the keeper member 51 so it is not readily apparent to others. The keeper member 51 is movable forwardly to a remote inoperative gun releasing position (shown in solid lines in FIG. 5) for inserting the pistol 12 into the holster and during an unlocking action to permit the pistol to be withdrawn for use, as will now be described.

The operation of the latching mechanism is simple and will be readily apparent from the foregoing structural description. With the lock straps 38, 39 in open condition and the keeper member 51 in its forward released position, a pistol 12 is inserted through the upper opening 36 into the interior sheath chamber of the holster body 30 and manually depressed with the muzzle 20 engaged against the bottom web 54 thus stretching the side walls 52, 53 of resilient saddle member 50 to yieldably oppose such downward movement and create the upwardly biasing force on the pistol. With the pistol 12 substantially in its fully depressed position against the saddle member 50 under manual force as shown in full lines in FIG. 5, the rigid keeper member 51 is pivoted rearwardly over the pistol butt to one of the gun retaining positions shown in broken lines in FIG. 5 and the downward manual force is removed to permit the pistol to be biased upwardly and be releasably held or locked under such pressure by the bearing engagement of the saddle member yoke 66 in the butt recess 27 or behind the rearwardly extending thumb spur or barrel shoulder projection. Thus, the pistol 12 is securely held between the opposing resilient saddle (54) and rigid yoke (66), and cannot be withdrawn either by forcibly attempting to pull it out or by merely depressing and turning the pistol during attempted withdrawal. In addition, engagement of the saddle yoke 66 behind the thumb spur shoulder 26 provides the safety feature of blocking firing hammer movement and preventing the pistol 12 from being discharged within the holster 30. Operation of the present invention requires a direct positive forward movement of the yoke section 66 to its released position for pistol withdrawal, and it should be noted that this is easily accomplished by the trained law officer in a quick hand movement that hits the quick release thumb break lock tab 38 with the heel of the thumb to unsnap the lock straps 38, 39 and thumb pushes or flicks the saddle member 51 forwardly over the thumb spur 25 or like butt projecting shoulder (22) to its remote released position as the heel of the hand is engaging the handle section 14 and depressing the pistol 12 against the resilient saddle member 50 within the holster body 30. Further, this downward loading of the resilient member 50 then provides an upward force assisting withdrawal of the pistol 12.

The method of making the holster 10 of the present invention includes the steps of forming complementary blanks of the inner and outer plies 45, 46 to form the holster body 30. The elongated slots 58 are formed in the rear and front wall members 31, 32 of the inner ply 45, and the opposed openings 70 are also punched through the inner ply walls, preferably in one operation with the formation of the slots 58. The end portions 56 of the saddle member side wall sections 52, 53 are inserted through the slots 58 to lie flat along the inner ply interface surface 60 above the slots. The end portions 56 are then permanently secured to the inner ply 45 by stitching 57 or the like, and the resiliency of the saddle member 50 permits it to be stretched to carry out this assembly operation. Any other stitching, such as lower stitching 61 or adhesive application to secure the saddle member permanently to the inner ply 45 is carried out at this time.

The T-nuts 71 are then oriented in the openings 70 of the inner ply 45, and are retained in place during the process of laminating the inner and outer plies 45, 46 together using acceptable laminating techniques, and the main body may be stitched (80) around its outer periphery to prevent separation of the plies 45, 46. The holster body 30 is shaped and the rear margins 34 brought together and stitched (35) to create the body sheath. When the holster body 30 is shaped, the keeper member 51 is assembled within the sheath cavity by applying the high pins 72 through the ends 67 and washers 73 to the T-nuts 71. Obviously, the lock strap fasteners 40, 41 and lock break strip 38 may be applied at a convenient stage in assembly, as well as application of the belt loop 43 or the like, these features being conventionally applied as will be understood. It should also be recognized that one or more partial body blanks of the inner ply 45 may be designed as basic structural members of partial size to mount the opposing saddle 54 and yoke 66 in proper relationship, and provide for attachment of thumb break ribs 42 and belt loop 43, and only the outer ply 46 (and exterior dress covering, if separate) need to be of full holster size.

The invention embodies changes and modifications that will be readily apparent to those skilled in the art, and y to be limited by the scope of the appended claims.

What is claimed is:

1. An anti-theft holster for a pistol, comprising a holster body shaped to form a sheath with an interior chamber for housing the pistol and having a lower muzzle end and an upper pistol receiving opening, lock strap means on said holster body adjacent to said upper opening including at least one strap member foldable over a butt portion of a pistol housed in said sheath chamber, resilient means constructed and arranged within the sheath chamber adjacent to the muzzle end for yieldably seating the muzzle end of the pistol, and non-yielding means adjacent to the upper opening for positively engaging and retaining the butt end of the pistol within said sheath chamber in opposed relation to said resilient means, said non-yielding means being movable relative to said upper opening between said operative pistol engaging position and an inoperative pistol releasing position when the pistol is depressed in the holster body against said resilient means.

2. The holster according to claim 1, in which said holster body has opposed rear and front wall members defining the inner side walls of said sheath chamber, and said resilient means is located between said inner side walls and is movable toward said muzzle end under downward pressure exerted by the pistol muzzle in its housed condition within said sheath chamber.

3. The holster according to claim 2, in which said resilient means comprises a saddle member having a yieldable muzzle engaging web section positioned between said inner side walls of said sheath chamber.

4. The holster according to claim 3, in which said saddle member includes opposed expansible side wall sections connected to said web section and having end portions, and means for securing the end portions of said side wall sections to the opposed rear and front wall members of said holster body.

5. The holster according to claim 4, in which said securing means includes means overlying and containing the end portions of said side wall sections to isolate said end portions from exposure to said sheath chamber.

6. The holster according to claim 4, in which said rear and front wall members have inner and outer plies of holster body forming material, said inner ply having opposed elongated sits in the respective rear and front wall forming members thereof for receiving the end portions of said side wall sections therethrough to lie in surface contact between said inner and outer plies, and said securing means including means for fastening said end portions to said inner ply.

7. The holster according to claim 4, in which said opposed side wall sections extend downwardly from said securing means and are connected to said web section in a closed loop to form a bottom saddle for said yieldable seating of the pistol muzzle.

8. The holster according to any of claims 1, 2, 3, 4, 5, 6 or 7 in which said resilient means comprises a unitary band of elastic material having integrally connected side wall and web sections.

9. The holster according to claim 1, in which said holster body has opposed rear and front wall members defining the inner side walls of said sheath chamber, and said non-yielding means comprises a keeper member including rigid yoke means located between the upper portions of said rear and front wall members adjacent to the upper pistol receiving opening to define the upper butt limit of a housed pistol in its pistol butt engaging position.

10. The holster according to claim 9, in which said keeper member includes means for mounting said yoke means for lateral movement toward and away from said upper pistol receiving opening between the operative pistol engaging position and the inoperative pistol releasing position.

11. The holster according to claim 10, in which said mounting means of said keeper member include opposed side wall sections connected to said yoke means and having end portions spaced therefrom, and means for pivotally attaching said end portions of said keeper member side wall sections to the opposed rear and front wall members of said holster body.

12. The holster according to claim 11, in which said rear and front wall members inner and outer plies of holster body forming material, said inner ply having an opposed set of openings formed therethrough in the respective rear and front wall forming members thereof, and said attachment means comprising hinge pin means mounted through said openings.

13. The holster according to claim 9, in which said lock strap means comprise rear and front lock straps members extending upwardly on said rear and front wall members in front of said upper pistol receiving opening, means for cooperatively fastening said lock strap members together in a pistol butt confining position, and said yoke means of said keeper member being positioned under said one lock strap member in its operative pistol engaging position.

14. The holster according to claim 13, in which said one lock strap means engages said yoke means to restrain lateral movement thereof from its pistol engaging position when said lock strap means are cooperatively fastened, and said lock strap fastening means being releasable to permit movement of said yoke means to its inoperative pistol releasing position.

15. An anti-theft holster for retaining a pistol comprising a main holster body casing shaped to form opposed near and front wall members connected together and defining a sheath having an interior chamber for housing the pistol, said body casing having a lower muzzle end and forming a pistol receiving upper opening to said sheath chamber, lock strap means on said body casing adjacent to said upper opening including at least one strap member foldable over a butt portion of a pistol housed in said sheath chamber, resilient means extending between said rear and front wall members adjacent to said muzzle end for seating the muzzle end of a pistol, non-yielding means extending between said rear and front wall members adjacent to said upper opening and having an operative position adapted for locking engagement with the butt end of a pistol housed in said sheath chamber, said non-yielding means being selectively movable laterally away from said upper opening to a remote, inoperative position of non-engagement.

16. The holster according to claim 15, in which said resilient means comprises a saddle member having a muzzle engaging web section positioned between said rear and front wall members and upwardly extending side wall sections connected to said web section, and means for securing the upper end portions of said side wall sections to said rear and front wall members of said body casing.

17. The holster according to claim 15, in which said non-yielding means comprises a keeper member having a rigid yoke section positioned between said rear and front wall members adjacent to said upper opening and side wall sections connected to said yoke section, said keep member side wall sections extending downwardly from said yoke section and having lower end portions, and means pivotally attaching said lower end portions to said rear and front wall members of said body casing.

18. The holster according to claim 15, in which said lock strap means comprise rear and front strap members being upwardly formed on said rear and front wall members and in part forming said upper opening, means for releasably fastening said lock strap members in closed pistol confining position, and said non-yielding means being positioned under said one lock strap member and confined against lateral movement in the closed position of said lock strap members.

* * * * *